US006345425B1

(12) United States Patent
Rosasco et al.

(10) Patent No.: US 6,345,425 B1
(45) Date of Patent: Feb. 12, 2002

(54) ROLLFORMER WITH TRANSVERSE SCORER

(75) Inventors: James J. Rosasco; Douglas L. Witte, both of Grand Haven; Peter Sturrus, Ludington, all of MI (US)

(73) Assignee: Shape Corporation, Grand Haven, MI (US)

( * ) Notice: Subject to any disclaimer, the term of this patent is extended or adjusted under 35 U.S.C. 154(b) by 0 days.

(21) Appl. No.: 09/457,550

(22) Filed: Dec. 9, 1999

(51) Int. Cl.[7] ..... B21P 25/00; B23P 17/00

(52) U.S. Cl. ..... 29/33 D; 29/33 T; 29/33 Q; 29/413; 219/64; 228/13; 83/865; 428/572

(58) Field of Search ..... 29/413, 412, 414, 29/791, 819, 33 D, 33 T, 33 Q, 890.053; 219/64, 66; 228/13, 18; 83/861, 862, 863, 864, 879, 880, 881, 883, 884, 865; 225/2, 94, 96, 96.5; 428/571, 572; 413/55, 69, 71, 72, 73

(56) References Cited

U.S. PATENT DOCUMENTS

| | | | | |
|---|---|---|---|---|
| 2,098,989 A | | 11/1937 | Yoder | |
| 2,127,618 A | | 8/1938 | Riemenschneider | |
| 2,158,400 A | * | 5/1939 | Chamberlin | 29/33 D |
| 2,222,842 A | | 11/1940 | Humphrey | |
| 2,444,463 A | | 7/1948 | Nordquist | |
| 2,741,023 A | | 4/1956 | Rafter | |
| 2,766,516 A | | 10/1956 | Chantler | |
| 2,781,816 A | | 2/1957 | Lawson | |
| 2,862,292 A | | 12/1958 | Lawson | |
| 3,052,975 A | | 9/1962 | Walters et al. | |
| 3,072,770 A | | 1/1963 | Goodridge | |
| 3,124,872 A | | 3/1964 | Knodel, Jr. | |
| 3,165,815 A | | 1/1965 | Wogerbauer | |
| 3,233,443 A | | 2/1966 | Lawson | |
| 3,236,083 A | | 2/1966 | Linderoth, Jr. et al. | |
| 3,285,212 A | | 11/1966 | Obidowski | |
| 3,338,554 A | | 8/1967 | Gostomski | |
| 3,344,641 A | | 10/1967 | Pomory | |
| 3,524,246 A | | 8/1970 | Hudosn et al. | |
| 3,595,527 A | | 7/1971 | Douglass | |
| 3,738,613 A | | 6/1973 | Hollis, Jr. | |
| 3,764,109 A | | 10/1973 | Hollis, Jr. | |
| 3,777,530 A | | 12/1973 | Jansson | |
| 3,902,552 A | | 9/1975 | McLain | |
| 3,918,626 A | | 11/1975 | McLain | |
| 3,921,883 A | | 11/1975 | McLain | |
| 4,025,749 A | | 5/1977 | Spurr et al. | |
| 4,109,500 A | | 8/1978 | Franek | |
| 4,142,663 A | | 3/1979 | Blatnik et al. | |
| 4,189,821 A | | 2/1980 | Potter | |

(List continued on next page.)

FOREIGN PATENT DOCUMENTS

| | | | |
|---|---|---|---|
| JP | 8-25229 | 1/1996 | B24D/13/08 |
| JP | 9-201232 | 8/1997 | A46B/7/10 |

*Primary Examiner*—S. Thomas Hughes
*Assistant Examiner*—Marc Jimenez
(74) *Attorney, Agent, or Firm*—Price Heneveld Cooper DeWitt & Litton

(57) ABSTRACT

An apparatus includes a scoring device for making transverse score lines on a roll of sheet material, a dimpler device or dimpler roller for making dimples adjacent the score lines at predetermined width locations, and a rollformer adapted to continuously form the sheet material into a tubular shape with channels. A welder is positioned in line with the rollformer and is adapted to weld the tubular shape into a permanent tube. A break off device positioned in line with the rollformer is adapted to break off sections of the tube at the score lines as the permanent tube exits the rollformer. The dimpler device is adapted to form an "in" dimple and an "out" dimple at locations coordinated with the score lines and with a width of the sheet material so that the "out" dimple forms a stop configured to slip into a channel formed in the sheet material by the rollformer but that abuts the "in" dimple which is formed at an end of the channel.

35 Claims, 4 Drawing Sheets

U.S. PATENT DOCUMENTS 4,434,638 A 3/1984 Sivachenko
4,593,550 A 6/1986 Byrd
4,621,511 A 11/1986 Knudson
4,660,754 A 4/1987 Byrd
4,941,402 A * 7/1990 D'Alterio ..... 99/450.6
5,123,629 A 6/1992 Takeuchi
5,427,595 A 6/1995 Pihl et al. ..... 51/298
5,443,906 A 8/1995 Pihl et al. ..... 428/370
5,454,504 A 10/1995 Sturrus
5,460,883 A 10/1995 Barber, Jr. et al. ..... 428/370
5,491,025 A 2/1996 Pihl et al. ..... 428/373
5,518,794 A 5/1996 Barber, Jr. et al. ..... 428/95
5,571,296 A 11/1996 Barber, Jr. et al. ..... 51/295
5,616,411 A 4/1997 Barber, Jr. et al. ..... 428/373
5,679,067 A 10/1997 Johnson et al. ..... 451/527
5,737,794 A 4/1998 Barber, Jr. et al. ..... 15/229.12
5,829,666 A 11/1998 Takeda et al.
5,837,179 A 11/1998 Pihl et al. ..... 264/172.11
5,849,052 A 12/1998 Barber, Jr. ..... 51/298
5,903,951 A 5/1999 Ionta et al. ..... 15/180
5,915,436 A 6/1999 Johnson et al. ..... 15/187
5,964,006 A 10/1999 Holmes et al. ..... 15/180
5,983,434 A 11/1999 Eichinger et al. ..... 15/180
6,061,905 A * 5/2000 Logic ..... 29/33 D

* cited by examiner

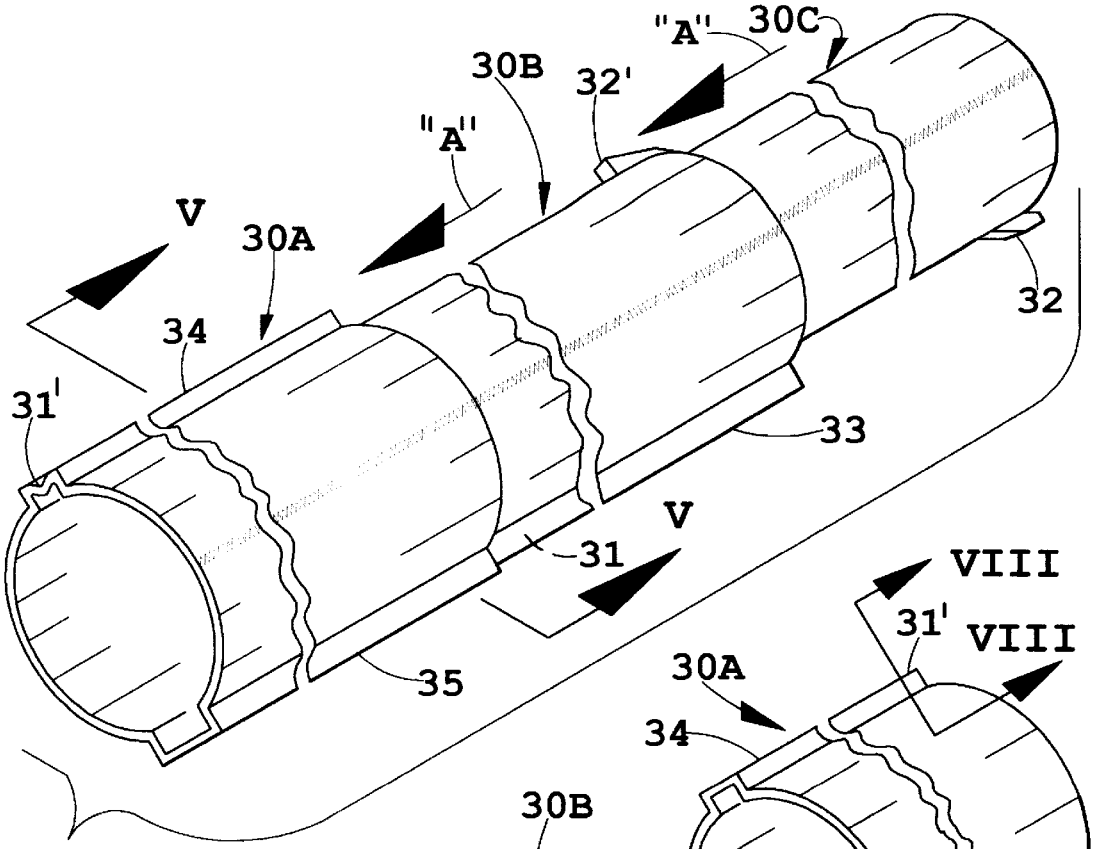
FIG. 4
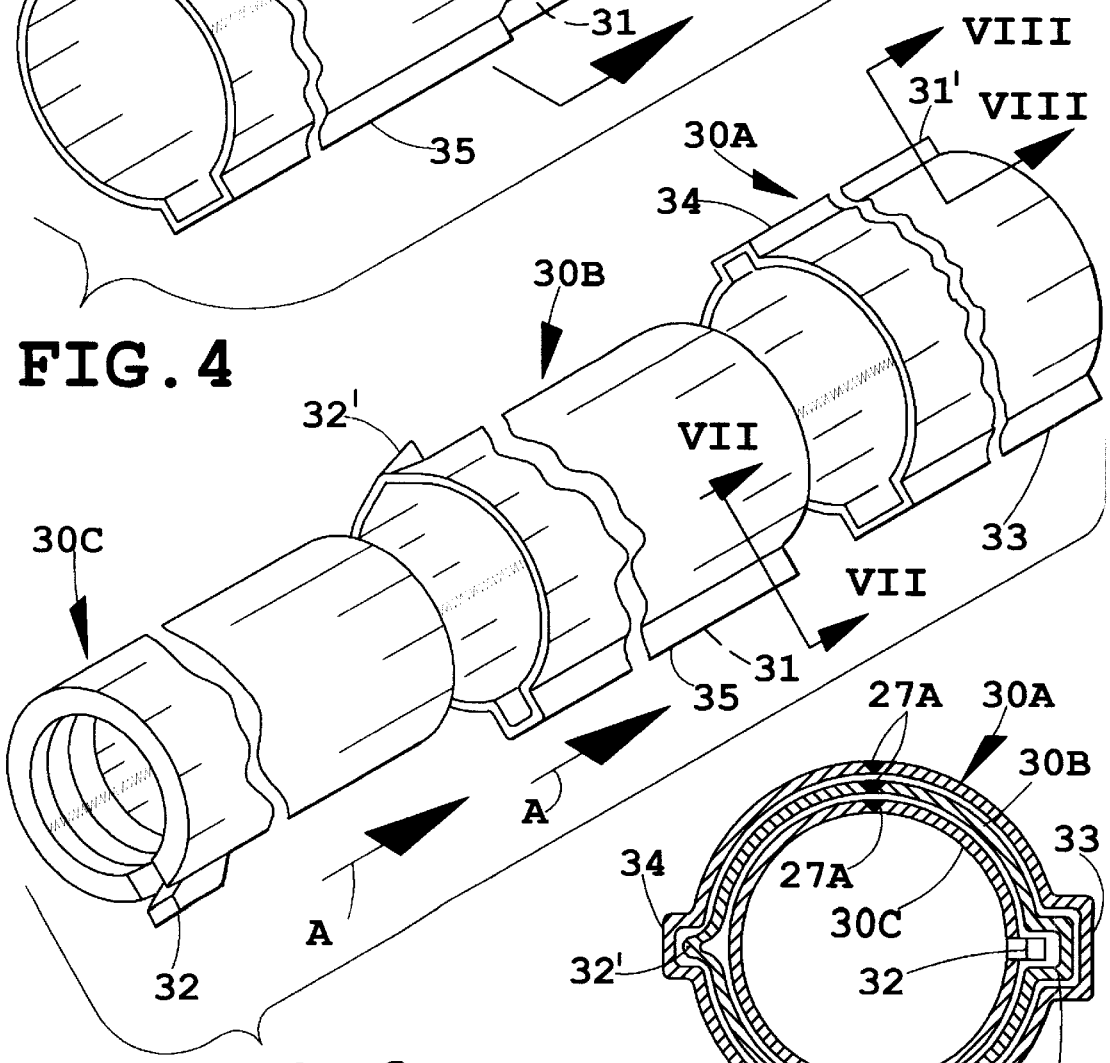
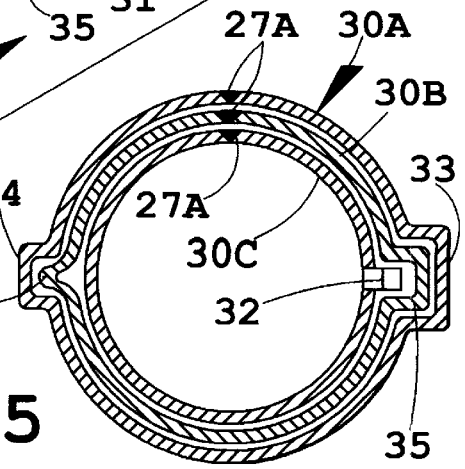
FIG. 6 FIG. 5

ROLLFORMER WITH TRANSVERSE SCORER

BACKGROUND OF THE INVENTION

The present invention relates to an apparatus configured to manufacture tubes, and more particularly relates to an apparatus that includes a rollformer and additional forming devices coordinated with the rollformer to facilitate the manufacture of tube sections with stops and stop-receiving guide channels, and also to facilitate the separation of the tube sections at an end of the rollformer.

There exists a prior art car jack (for lifting a vehicle to change tires) that uses, as part of its assembly for vertical strength, three telescoping tube sections that telescopingly mate together. The three tube sections are configured to longitudinally slide between a collapsed position where all three tube sections lie within each other, and an extended position where all three tube sections extend from each other (with only an inch or so of each tube section overlapping with the next tube section). The arrangement also permits the three tube sections to telescopingly slide together during assembly of the jack. The inner one of the three tube sections includes a first "out" dimple. The intermediate one of the three tube sections includes a first channel for receiving the first "out" dimple and also includes a second "out" dimple. The outer one of the three tube sections includes a second channel for receiving the second "out" dimple, and a third channel for receiving the first channel. A first "in" dimple is formed at an end of the first channel and is configured to abut the first "out" dimple to limit telescoping movement of the inner and intermediate tube sections. A second "in" dimple is formed at an end of the second channel and is configured to abut the second "out" dimple to limit telescoping movement of the intermediate and outer tube sections.

The above-described three tube sections are made by tube-forming techniques, where a tube section is initially cut to length and then stamped/re-formed to include the various "in" dimples, "out" dimples, and channels or keyways. However, the tube-forming technique is relatively costly for many reasons. It requires considerable multiple forming steps which result in considerable handling, tooling, and machinery. This in turn results in high labor and processing costs, high overhead, and high in-process inventory, all of which are expensive. Further, there can be considerable variation in the manufactured tube sections, particularly over time as dies wear, which can be problematic because the jack requires that the tube sections maintain tight tolerances that permit smooth telescoping movement without sloppiness or binding. For example, if one tube section has a diameter that is non-round or oversized, the mating tube section will either bind and not telescope, or it will be sloppy and unable to maintain a linear telescoping action such that it will buckle. Also, for example, if a dimple or channel is not properly formed, the dimples will not properly engage to limit telescoping movement, which will result in the jack potentially coming apart, resulting in an upset vehicle owner and/or potential safety hazard.

An apparatus and method of manufacturing tube sections is desired that solves the aforementioned disadvantages and that offers the aforementioned advantages, where the apparatus and method are capable of providing tube sections shaped for telescoping mating use, and are capable of producing the same at high volume, low labor, low cost, and with high dimensional accuracy.

SUMMARY OF THE PRESENT INVENTION

In one aspect of the present invention, an apparatus includes a scoring device for making transverse score lines on a roll of sheet material, and a rollformer adapted to continuously form the sheet material into a tubular shape. A welder is positioned in line with the rollformer and is adapted to weld the tubular shape into a permanent tube. A break-off device positioned in line with the rollformer is adapted to break off sections of the tube at the score lines.

In another aspect of the present invention, an apparatus includes a scoring device for making transverse score lines on a roll of sheet material, the score lines having a non-uniform depth across a width of the sheet material. A rollformer is provided that is adapted to continuously form the sheet material into a tubular shape. A welder is positioned in line with the rollformer and is adapted to weld the tubular shape into a permanent tube.

In another aspect of the present invention, an apparatus includes a scoring device for making transverse score lines on a roll of sheet material, and a dimpler adapted to form a stop dimple at a location coordinated with the score lines. A rollformer is adapted to continuously form the sheet material into a tubular shape having a longitudinal guide channel therein, with the stop dimple being along the guide channel. A break off device is positioned in line with the rollformer is adapted to break off sections of the tube at the score lines.

In another aspect of the present invention, an apparatus includes a roll of sheet metal of at least about 0.075 inches thickness, and a scoring device for making transverse score lines on the sheet metal. A rollformer is adapted to roll the sheet metal into tubular shape. A break-off device is positioned in line with the rollformer that is adapted to break off sections of the tubular shape at the score lines.

In another aspect of the present invention, a method includes steps of providing a roll of sheet material, making transverse score lines in the sheet material, providing a rollformer, and rollforming a tubular shape from the sheet of material using the rollformer. The method further includes welding the tubular shape into a permanent tube, and breaking off sections of the tube in line with an end of the rollformer during the step of rollforming.

In another aspect of the present invention, a method comprising steps of providing a roll of sheet material, making transverse score lines in the sheet material, providing a rollformer, and rollforming a tubular shape from the sheet of material using the rollformer. The method further includes forming a longitudinally extending channel and forming dimples in line with the rollformer in the tubular shape.

These and other aspects, features, and objects of the present invention will be further understood by reference to the following specification, claims, and appended drawings.

BRIEF DESCRIPTION OF DRAWINGS

FIG. 4 is an exploded fragmentary bottom perspective view of a three-piece tubular assembly used in a car jack, the three-piece tubular assembly being exploded apart and positioned in line for assembly, the three pieces being configured to telescope together to a compact storage position where each inner tube is inside the adjacent outer tube, and to telescope further to an extended position where each tube extends several inches out of the next, each piece potentially being made from the apparatus of FIG. 1;

FIG. 5 is a cross section taken along line V—V in FIG. 4;

FIG. 6 is an exploded fragmentary top perspective view of the three-piece tubular assembly shown in FIG. 4;

DETAILED DESCRIPTION OF PREFERRED EMBODIMENT

Figure 1:
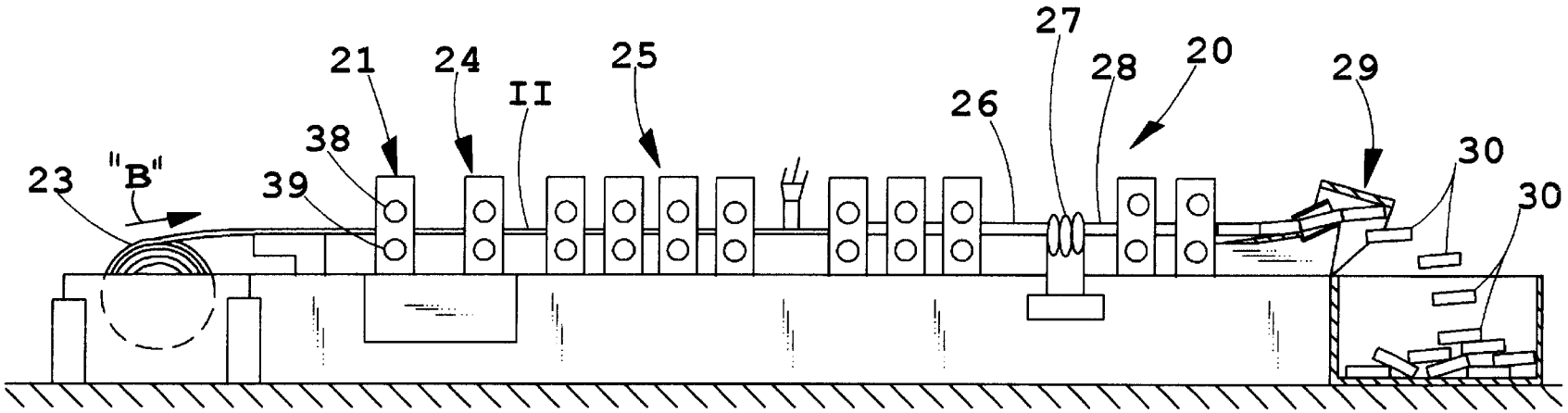
FIG. 1 is a side view of an apparatus embodying the present invention.

An apparatus 20 (FIG. 1) includes a scoring device 21 for making transverse score lines 22 (FIG. 2) on a roll of sheet material 23, a dimpler or punching device 24 for making dimples 31 and 32 adjacent the score lines 22 at a predetermined width location, and a rollformer 25 adapted to continuously form the sheet material 23 into a tubular shape 26. A welder 27 is positioned in line with and integrated into the rollformer 25 and is adapted to weld the tubular shape into a permanent tube 28. A break off device 29 positioned in line with and at an end of the rollformer 25 is adapted to break off tube sections 30 of the permanent tube 28 at the score lines 22 as the permanent tube 28 exits the rollformer 25 at high speed. The dimpler 24 is adapted to form an "in" dimple 31 and an "out" dimple 32 at locations coordinated with the score lines 22 and with a width of the sheet material so that the "out" dimple 32 forms one part of a stop on each tube section 30 and the "out" dimple forms one part of another stop on the tube section 30. The rollformer 25 forms one or more channels 33 (or 34 or 35) (FIG. 4) on each tube section, as discussed below. By the above apparatus and related method, tube sections having different diameters and different features can be made on different rollforming lines with the tube sections being configured to telescope together.

Figure 2:
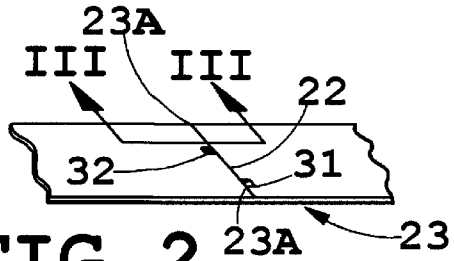
FIG. 2 is a fragmentary perspective view of the sheet at location II in FIG. 1.
Figure 7:
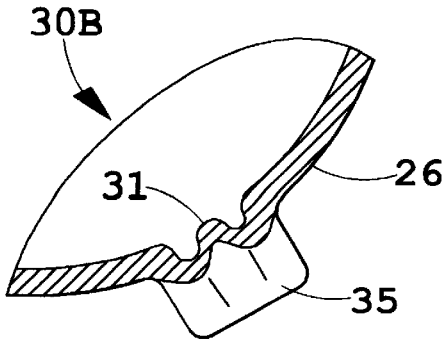
FIG. 7 is a cross section taken along line VII—VII in FIG. 6.
Figure 8:
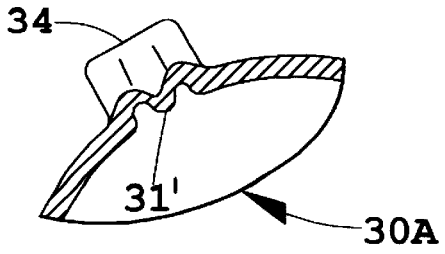
FIG. 8 is a cross section taken along line VIII—VIII in FIG. 6.

To facilitate the present description, the tube sections in FIG. 1 are referred to as tube section 30, while the three different tube sections illustrated in FIGS. 4–6 are referred to as tube sections 30A, 30B, and 30C. It is to be understood that the tube section 30 manufactured by the apparatus 20 can be any of the tube sections 30A, 30B, and 30C or reasonable variations thereof, as described below. In a preferred form, if the apparatus 20 is set up to run tube sections 30A, then only tube sections 30A can be run on that machine until the apparatus 20 is shut down and modified to run the other tube section 30B or the other tube section 30C. Naturally, multiple apparatus 20 can be run side by side to make the tubes (30A, 30B, and 30C) as needed. The rollforming apparatus 20 is operable at high speed and produces high quality and dimensionally accurate parts that are separated and that are substantially complete as the parts come off the rollform apparatus 20. It is contemplated that the present arrangement saves considerable costs, including reduced labor, reduced tooling costs, reduced machine time, and a substantial reduction of in-process inventories.

The present tube sections 30A, 30B and 30C are described below in sufficient detail to provide an understanding of the present invention. The illustrated tube sections 30A, 30B and 30C (FIGS. 4 and 6) are adapted to telescope together to form an extendable shield or jack screw housing of a car jack (used for lifting a vehicle to change a tire). The car jack uses, as part of its assembly for strength, stability and safety around the area of the jack screw, three extendable tube sections that telescopingly mate together between a collapsed position where all three tube sections 30A, 30B, and 30C are within each other, and an extended position where all three tube sections 30A, 30B and 30C are extended with only a short section overlapping. The illustrated tube sections 30A, 30B and 30C are shaped to replace the prior art tube sections in the prior art car jack. It is not believed to be important to describe the prior art car jack assembly in detail, since the present invention primarily concerns an apparatus and method for manufacturing tube sections, and the resulting product by process, and does not concern the jack assembly per se. The process for forming the prior art tube sections, to the extent known, is described in the background section of the present description. It is not believed to be important to describe the process for forming the prior art tube sections in detail since the present invention primarily concerns an apparatus and method that incorporates rollforming. Further, the specific tube forming techniques and stamping techniques used in the prior art tube sections are not known in detail. To the extent a person may be interested in tube-forming techniques and stamping techniques, it is noted that such techniques are generally well known in the art and are believed to be publicly available and in the public domain.

The three illustrated tube sections 30A, 30B and 30C (FIGS. 4 and 6) are configured to longitudinally slide together for assembly in direction "A" and thereafter be moveable between a collapsed position where all three tube sections 30A, 30B and 30C lie within each other, and an extended position where all three tube sections 30A, 30B and 30C extend from each other (with only part of an inch or so of each tube section overlapping with the next tube section). The inner tube section 30C of the three tube sections includes a first "out" dimple 32. The intermediate tube section 30B includes a first channel 33 for receiving the first "out" dimple 32 and also includes a second "out" dimple 32' at 180 degrees from the first channel 33. The outer tube section 30A includes a second channel 34 for receiving the second "out" dimple 32', and a third channel 35 for receiving the first channel 33. A first "in" dimple 31 is formed at an end of the first channel 33 and is configured to abut the first "out" dimple 32 to limit telescoping movement of the inner and intermediate tube sections 30C and 30B. A second "in" dimple 31' is formed at an end of the second channel 34 and is configured to abut the second "out" dimple 32' to limit telescoping movement of the intermediate and outer tube sections 30A and 30B. The "in" dimples and "out" dimples form pairs of abutting stops that engage to limit extension of the respective tube sections to a maximum extended position. The width of the "out" dimples are sufficiently narrow to slide easily along the respective channels that receive them, but are sufficiently wide to prevent them from sliding past the mating "in" dimples in the associated channels.

The roll of sheet material 23 (FIG. 2) can be any thickness or type of material to provide sufficient structure for the characteristics required of the tube sections 30. The particular illustrated sheet material 23 is cold rolled steel such as CRS 1008 or CRS 1010 or similar cold (or hot) rolled steel or other metal. The sheet material 23 has a thickness of about 0.070–0.085 inch thickness. Notably, aluminum sheet having a thickness of 0.125 to 0.150 inches could also be used. The roll of sheet material 23 is fed in a direction "B" from an uncoiler, through the scoring device 21 and the synchronized dimpler device 24 along the rollformer 25 with welder 27 to break-off device 29.

Figure 3:
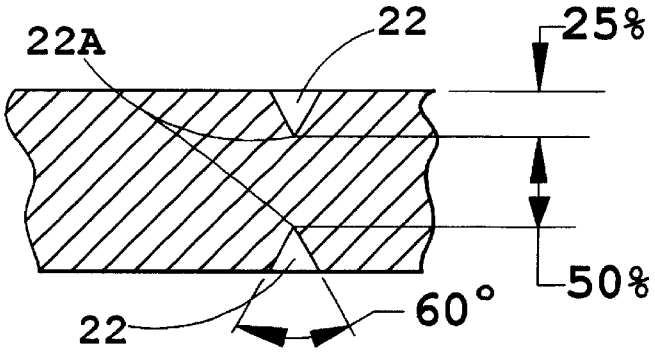
FIG. 3 is a cross section taken along line III—III in FIG. 2.
Figure 3A:
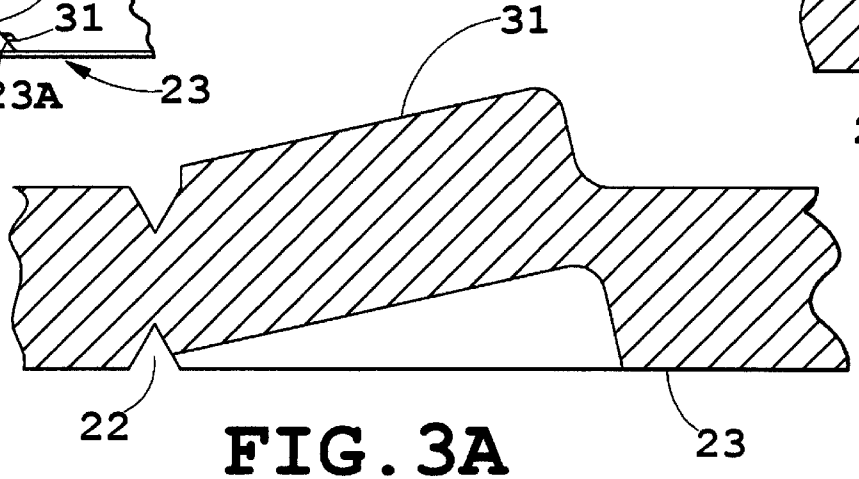
FIG. 3A is a cross section taken parallel line III—III but through a dimple roll-formed in the strip of FIG. 2.

The scored line 22 (FIG. 3) is formed by upper and lower score blades, each having a "V" shape with a relatively sharp point 22A. The relatively sharp point 22A assists the break-off device 29 in breaking apart successive tube sections 30 from each other, as described below. It is noted that a relatively sharp point 22A assists in crack initiation, but that the point 22A need not be sharp per se. In fact, it is contemplated that the scoring die forming the sharp point 22A will wear at its tip slightly over time, such that the point 22A at its extremity will be slightly rounded, yet the break-off device 29 will function very well and satisfactorily. In the illustrated material, the score lines (referred to collectively as scoring line 22) are preferably each about 20% to 25% deep, such that the combined total depth of the score lines is about 40% to 50% of the thickness of the material. The "V" forms an included angle of about 60 degrees. It is noted that the score lines may have different preferred shaped, depths, sizes, and etc, depending upon the sheet material being formed.

Figure 11:
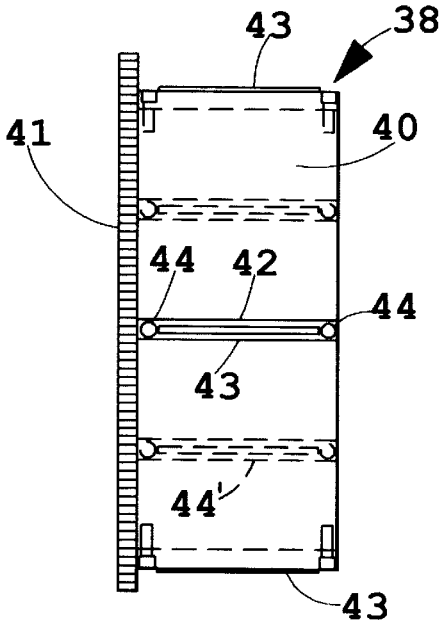
FIG. 11 is an enlarged view of one of the score rollers shown in FIG. 10.
Figure 9:
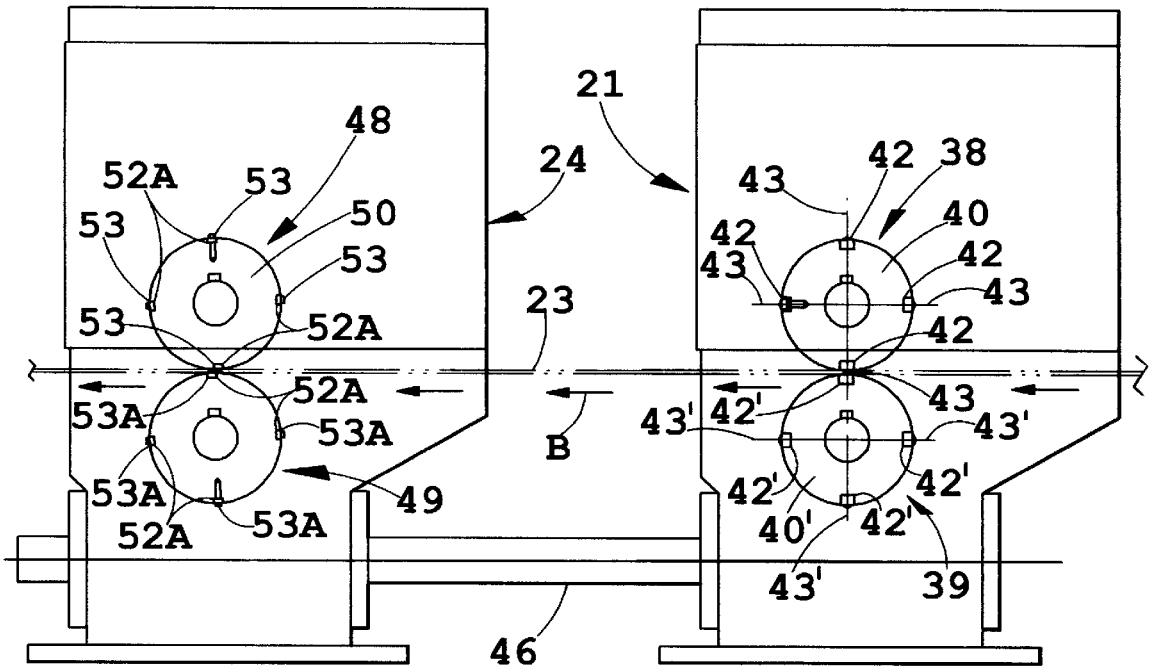
FIG. 9 is a side view of the scoring and punching roller stations on the apparatus of FIG. 1.

The scoring lines 22 are formed at a scoring station by the scoring device 21 (FIGS. 1 and 9) via a mating pair of scoring rollers 38 and 39. The top scoring roller 38 (FIG. 11) includes a roller body 40 having a gear 41 bolted to one side. The roller body 40 includes recesses 42 shaped to receive a scoring blade 43 that is secured in place with bolts 44. The illustrated roller body 40 has four recesses 42 equally spaced around the roller body 40. "Extra" blade recesses 44' (shown in dashed lines) may be provided for the purpose of selectively adding scoring blades 43. This allows blades 43 to be selectively secured to the scoring roller 38 at predetermined distances around the scoring roller 38. Optimally, the blades 43 are secured at equal distances apart so that each tube section produced has the same length as other tube sections and there is no waste. For example, where the distance around the scoring roller body 40 is 12 inches, four scoring blades 43 spaced 3 inches apart can be used to cut tube sections 30 that are each 3 inches long. Alternatively, if only half of the recesses 44 have scoring blades 43 attached, then the tube sections 30 are each 6 inches long. Alternatively, where the same roller body 40 (i.e. 12 inches around) has three scoring blades 43 spaced 4 inches apart, it forms tube sections 30 that are each 4 inches long.

The bottom scoring roller 39 (FIG. 9) is identical to the top scoring roller 38, with the exception that the gear attached to the scoring roller 39 has teeth offset slightly so that the scoring blades 43 of the top and bottom scoring rollers 38 and 39 are aligned with each other when their respective gears 41 are interengaged. Notably, it is contemplated that other means can be used to synchronize rotation of the top and bottom scoring rollers 38 and 39 other than gears 41. For example, a zero-backlash gearbox is known in the art. A zero-backlash gearbox, with the scoring rollers 38 and 39 keyed in position, can be used to operably interconnect the top and bottom scoring roller 38 and 39 and to operably connect the scoring rollers 38 and 39 to a drive shaft 46.

Figure 12:
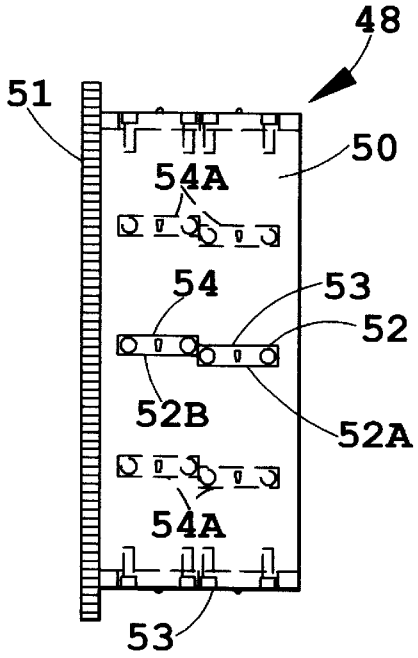
FIG. 12 is an enlarged view of one of the punch rollers shown in FIG. 10.
Figure 10:
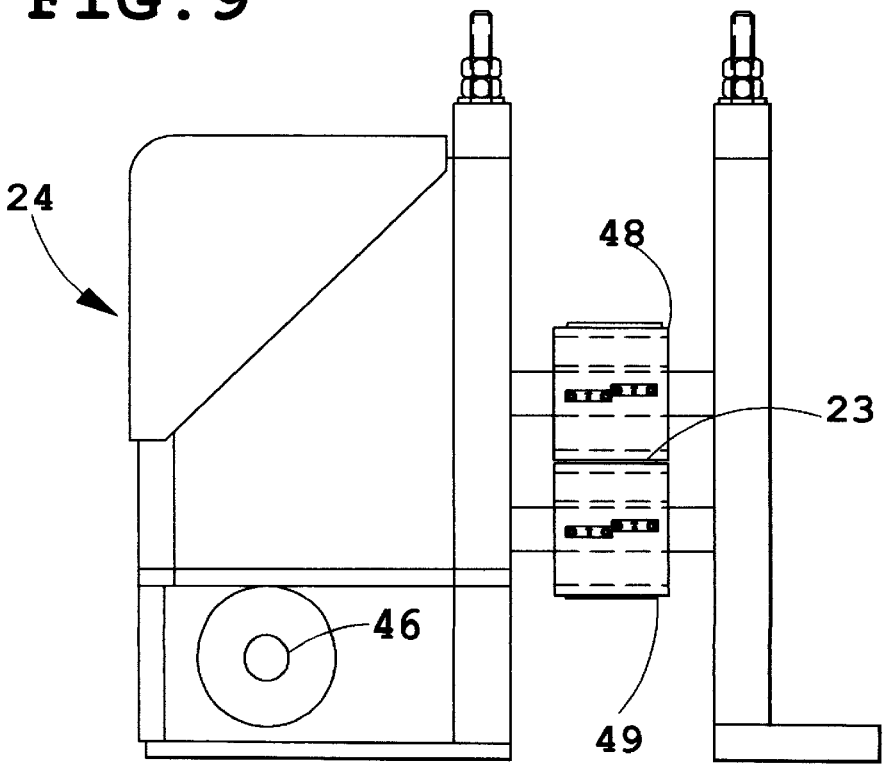
FIG. 10 is an end view of the scoring roller station on the apparatus of FIG. 1.

The dimpler 24 (FIGS. 9, 10 and 12) is located at a dimpler station or punch station, and includes top and bottom mating dimpler rollers 48 and 49 that are not unlike the scoring rollers 38 and 39. Specifically, the top dimpler roller 48 includes a roller body 50 having a gear 51 (FIG. 12) bolted to one side. The roller body 50 includes recesses 52 shaped to receive a die 52A having a dimpler punch 53 or female button 53A (FIG. 9) for matingly receiving a punch. The die 52A is secured in place with bolts 54. The illustrated roller body 50 (FIG. 12) has four pre-score-line recesses 52 and four post-score-line recesses 52B equally spaced around the roller body 50. "Extra" blade recesses 54A (shown in dashed lines) may be provided for the purpose of selectively adding dimpler punches 53 (or buttons 53A) as described below. This allows dimpler punches 53 or female buttons 53A to be selectively secured to the dimpler roller 48 at predetermined distances around the dimpler roller 48. Optimally, the punches 53 are secured at equal distances apart where they exactly match the scoring rollers 38. By this means, each tube section produced has the same length and the same dimples as other tube sections and there is no waste. For example, where the distance around the dimple roller body 50 is 12 inches, four pre-score-line dimpler punches 53 spaced 3 inches apart can be used to form dimples in tube sections 30 that are each 3 inches long. Alternatively, if only half of the recesses 54 have dimpler punches 53 attached, then the arrangement is useful for tube sections 30 that are each 6 inches long. It is noted that different spacing or lengths can be achieved by changing the diameter of the dimpler roller 48.

The bottom dimpler roller 49 (FIG. 9) has a roller body 50 that is identical to the top dimpler roller body 50, with the exception that the gear has teeth offset slightly so that the dimpler punches 53 (and/or bottoms 53A) of the top and bottom rollers 48 and 49 are aligned with each other when the gears 51 are interengaged. Notably, it is contemplated that other means can be used to synchronize rotation of the top and bottom dimpler rollers 48 and 49 other than gears 51. For example, a zero-backlash gearbox (known in the art) can be used to operably interconnect the top and bottom dimpler roller 48 and 49 and to operably connect the dimpler rollers 48 and 49 to the drive shaft 46. By using the same drive shaft 46, the dimpler station 47 and the scoring station 37 are always synchronized.

It is contemplated that a dimpler punch 53 can be secured in either or both of the recesses 52 and 52B in either one of the top and bottom dimpler rollers 48 and 49. Further, it is contemplated that a button 53A may be secured in the recess that corresponds to the selected recess 52 having a dimpler punch 53 to help form a sharper surface on the dimple (31 or 32). Punches 53 and buttons 53A are known in the art, and need not be described in detail for an understanding of the present invention. Basically, buttons 53A are female dies with recesses shaped to closely receive edges of a protruding portion of a dimpler punch 53. By this means, they assist in accurately forming and shaping dimples (31 and 32) formed by dimpler punches 53. When used, the button 53A is secured in one of the recesses 52 at a location corresponding to the punch 53 that it is to receive. It is noted that buttons may not be required in some circumstances. Some of the illustrated recesses 52 are located at pre-scoring-line locations, while other recesses 52A are located at post-scoring-line locations. It is contemplated that these recesses could be enlarged to straddle the scoring lines 22. This would allow the recesses to receive dimpler punches having protruding portions that are located in one or both of the pre-score-line and post-score-line positions.

Preferably, the drive shaft 46 (FIG. 9) is connected to the drive shaft of the rollformer 25, such that operation of the rollformer 25 automatically operates the score and punch drive shaft 46. Alternatively, separate drive shafts and motors can be used.

The scoring rollers 38 and 39 are configured to mark the score line 22 across a width of the sheet material 23. The score line 22 may have a continuously uniform depth across the sheet material, but it does not have to have a uniform depth completely across the width. For example, it may be desirable to make a shallower score line 22 (or no score line at all) near the edges 23A of the sheet material 23. A reason for a shallower score line 22 is so that when the material is welded, the welder 27 does not blow holes in the material at the score line 22, where the weld heat is focused by the score line 22. On the other hand, some minor weld blowing may in fact be desirable since it can help the break-off operation, particularly since the welded material has changed properties due to the weld heat. This depends largely on the material or thickness of the sheet, the welding parameters, a speed of the rollformer, and numerous other variables connected with the overall process. The optimal depth of the score line 22 at edges of the sheet material 23 appears to be a depth that is sufficiently shallow enough to reduce weld blowing to an acceptable amount, but that does cause some weld blowing to occur. Specifically, it is contemplated that a score line depth at the edges preferably should be about 10% to 20%, and/or perhaps be only marked on one side.

Welding of tubular steel is well known in the art. For example, welding of steel sheet rollformed into a tubular shape is disclosed in U.S. Pat. No. 5,454,504 to Sturrus. It is noted that many different types of welders are well known in the art and can be used for welder 27, including continuous and non-continuous welders (e.g. spot welders). Notably, it is contemplated that features of the present apparatus 20 may be useful even where welding is not used, or where another form of securement other than welding is used, such as overlapping of folded edge flanges or adhesive. In the present embodiment, a continuous weld bead 27A (FIG. 5) is made along the entire permanent tube 28. If desired, a void caused by a weld blowing could occur at extreme ends of the tubes (i.e. at the score lines). Such voids would not be detrimental, and may, in fact, help the break-off step.

Figure 13:
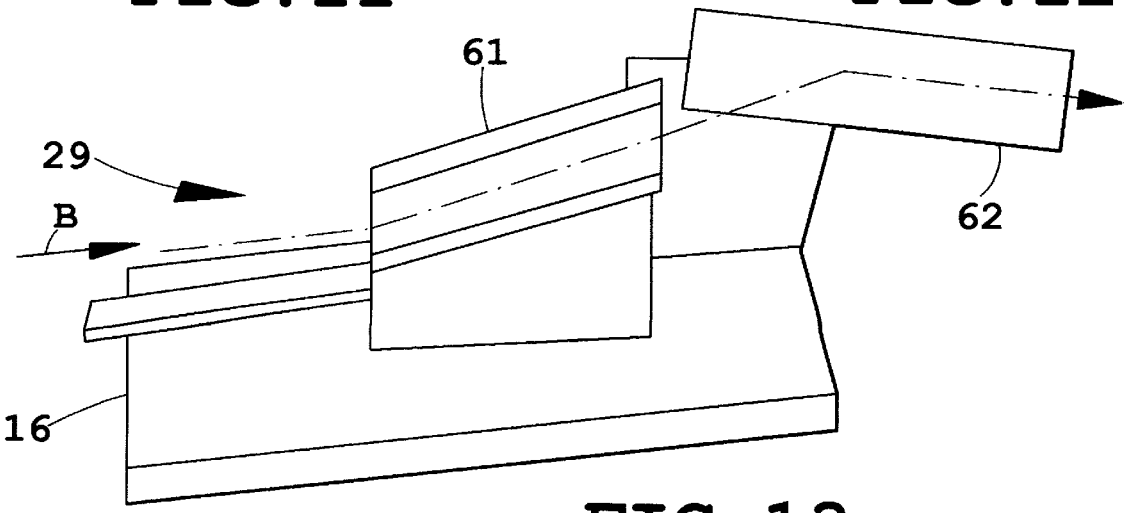
FIG. 13 is a perspective view of the break-off device shown in FIG. 1.

The break-off device 29 (FIG. 13) includes a base 60, an up deflector 61 and a down deflector 62. The permanent tube 28 enters the up deflector along a horizontal direction "B" . The up deflector 61 includes opposing C-shaped halves bolted together to form a tubular hole that is slightly larger than but close in diameter to the scored permanent tube 28 coming off of the rollformer 25. The down deflector 62 is a C-shaped member that defines a path generally aligned with the tubular hole but that extends at a down angle. The up deflector 61 and down deflector 62 have a length that generally matches but is a little longer than a length of the tube section 30 being broken. The up and down deflectors 61 and 62 are generally aligned with the direction of travel "B" of the permanent tube 28 as it comes off the rollformer 25, but the up deflector 61 forces the tube 28 to bend up at about a 20 to 30 degree angle such that the permanent tube 28 breaks a first time, and then the down deflector 62 forces the tube to bend down at about a 20 to 30 degree angle such that the permanent tube 28 breaks into the tube sections 30. The up angle and down angle are chosen to be enough to positively and reliably break the permanent tube 28 at the score lines 22, thus forming the tube sections 30. It is contemplated that other breaking means can be used, such as an impact hammer or wedge, or hammer that cycles as each tube section 30 crosses over a break-point fulcrum if desired, but the present break-off device 29 is reliable, relatively quiet, passive, low maintenance, and very inexpensive. It is contemplated that the present break-off device 29 will function effectively for a wide variety of tube sizes, but it is believed to be particularly effective where tube sections 30 have a diameter range that is from about 1½ inches up to about 3 inches, and that have a length range of about 4 to 8 inches long.

It will be readily apparent to those skilled in the art that modifications and changes can be made from the disclosed preferred embodiment without departing from a scope of the present invention. Such modifications and variations are to be considered as included in the present invention, unless the claims by their language expressly require otherwise.

The invention claimed is:

1. An apparatus comprising:

a scoring device including at least one scoring blade defining a non-uniform depth dimension along a length of the scoring blade for making non-uniformly deep transverse score lines on a roll of sheet material;

a rollformer adapted to continuously form the sheet material into a tubular shape;

a welder positioned in line with the rollformer and that is adapted to weld the tubular shape into a permanent tube;

a break-off device in line with the rollformer that is adapted to break off sections of the tube at the score lines; and a dimpler for forming dimples adjacent the scoring lines; the dimpler including a dimpler punch that forms a protruding dimple adjacent each one of the scoring lines, the dimpler including top and bottom dimpler rollers having top and bottom punches, the top and bottom punches being configured to form up and down dimples in the sheet material.

2. The apparatus defined in claim 1, wherein the at least one scoring blade includes top and bottom scoring members for making top and bottom score lines.

3. The apparatus defined in claim 2, wherein the top and bottom scoring members include top and bottom scoring blades that are aligned with each other and that are removable.

4. The apparatus defined in claim 3, wherein the top and bottom scoring members are configured to make at least part of the top and bottom score lines extend to a depth of at least 20% of a thickness of the sheet material.

5. The apparatus defined in claim 1, wherein the scoring device is configured to make at least a portion of the scoring line extend into the sheet material a total of at least about 20% to about 50% of a thickness of the sheet material.

6. The apparatus defined in claim 1, wherein the scoring device is configured to make edge portions of the scoring lines significantly shallower than center portions of the scoring lines.

7. The apparatus defined in claim 6, wherein the welder includes a continuous-bead welding device configured to form an elongated weld bead that bonds edges of the sheet material together to form the permanent tube, but which elongated weld bead is interrupted by blown holes that occur at the scoring lines.

8. The apparatus defined in claim 1, wherein the rollformer includes forming rolls shaped to rollform a longitudinal channel in the permanent tube, and wherein the dimpler is configured to form a dimple in the sheet material that ends up in an end of the channel.

9. The apparatus defined in claim 1, wherein the break-off device includes an up-bending section and a down-bending section that are adapted to bend the permanent tube upwardly until the permanent tube breaks along each of the scoring lines, and bend the permanent tube downwardly until the permanent tube breaks into the tube sections.

10. The apparatus defined in claim 1, wherein the scoring device includes a scoring roller.

11. An apparatus comprising:

a scoring device including at least one scoring blade defining a non-uniform depth dimension along a length of the scoring blade for making non-uniformly deep transverse score lines on a roll of sheet material;

a rollformer adapted to continuously form the sheet material into a tubular shape;

a welder positioned in line with the rollformer and that is adapted to weld the tubular shape into a permanent tube;

a break-off device in line with the rollformer that is adapted to break off sections of the tube at the score lines; and a dimpler for forming dimples adjacent the scoring lines; the dimpler including a dimpler punch that forms a protruding dimple adjacent each one of the scoring lines, the dimpler including pre-scoring-line punches and post-scoring-line punches adapted to form dimples ahead of and after each scoring line.

12. The apparatus defined in claim 11, the dimpler includes a dimpler roller having the dimpler punch thereon.

13. The apparatus defined in claim 11, wherein the scoring device is configured to make at least a portion of the scoring line extend into the sheet material a total of at least about 20% to about 50% of a thickness of the sheet material.

14. The apparatus defined in claim 11, wherein the welder includes a continuous-bead welding device configured to form an elongated weld bead that bonds edges of the sheet material together to form the permanent tube, but which elongated weld bead is interrupted by blown holes that occur at the scoring lines.

15. The apparatus defined in claim 11, wherein the rollformer includes forming rolls shaped to rollform a longitudinal channel in the permanent tube, and wherein the dimpler is configured to form a dimple in the sheet material that ends up in an end of the channel.

16. An apparatus comprising:

a scoring device for making transverse score lines on a roll of sheet material, the scoring device including a scoring member defining a non-uniform depth dimension along a length of the scoring member for making non-uniformly deep score lines across a width of the sheet material;

a rollformer adapted to continuously form the sheet material into a tubular shape;

a welder positioned in line with the rollformer and that is adapted to weld the tubular shape into a permanent tube; and a dimpler for forming dimples adjacent the scoring lines, the dimpler including top and bottom dimpler rollers having top and bottom punches, the top and bottom punches being configured to form up and down dimples in the sheet material.

17. The apparatus defined in claim 16, wherein the scoring device includes top and bottom scoring members for making top and bottom score lines, the top scoring member being the first-mentioned scoring member.

18. The apparatus defined in claim 17, wherein the top and bottom scoring members include top and bottom scoring blades that are aligned with each other and that are removable.

19. The apparatus defined in claim 18, wherein the top and bottom scoring members are configured to make at least part of the top and bottom score lines extend to a depth of at least 20% of a thickness of the sheet material.

20. The apparatus defined in claim 16, wherein the scoring device is configured to make at least a portion of the scoring line extend into the sheet material a total of at least about 20% to about 50% of a thickness of the sheet material.

21. The apparatus defined in claim 16, wherein the non-uniform scoring lines have edge portions that are significantly shallower than center portions of the scoring lines.

22. The apparatus defined in claim 16, wherein the welder includes a continuous-bead welding device configured to form an elongated weld bead that bonds edges of the sheet material together to form the permanent tube, but which elongated weld bead is interrupted by blown holes that occur at the scoring lines.

23. The apparatus defined in claim 16, wherein the rollformer includes forming rolls shaped to rollform a longitudinal channel in the permanent tube at a location angularly different from a weld formed by the welder, and further the dimpler is configured to form a dimple in the channel.

24. The apparatus defined in claim 16, including a break-off device having an up-bending section and a down-bending section that are adapted to bend the permanent tube upwardly until the permanent tube breaks along each of the scoring lines, and bend the permanent tube downwardly until the permanent tube breaks into the tube sections.

25. An apparatus comprising:

a scoring device for making transverse score lines on a roll of sheet material, the scoring device including a scoring member defining a non-uniform depth dimension along a length of the scoring member for making non-uniformly deep score lines across a width of the sheet material;

a rollformer adapted to continuously form the sheet material into a tubular shape;

a welder positioned in line with the rollformer and that is adapted to weld the tubular shape into a permanent tube; and a dimpler for forming dimples adjacent the scoring lines, the dimpler including pre-scoring-line punches and post-scoring-line punches adapted to form dimples ahead of and after each scoring line.

26. The apparatus defined in claim 25, wherein the rollformer includes forming rolls shaped to rollform a longitudinal channel in the permanent tube at a location angularly different from a weld formed by the welder, and further including a dimpler configured to form a dimple in the channel.

27. The apparatus defined in claim 25, including a break-off device having an up-bending section and a down-bending section that are adapted to bend the permanent tube upwardly until the permanent tube breaks along each of the scoring lines, and bend the permanent tube downwardly until the permanent tube breaks into the tube sections.

28. An apparatus comprising:

a scoring device for making transverse score lines on a roll of sheet material;

a dimpler adapted to form a stop dimple at a location coordinated with the score lines; the dimpler including a dimpler roller with dimple-forming punches located in coordinated positions to form stop dimples at locations spaced from the score lines;

a rollformer with rollers configured and adapted to continuously form the sheet material into a tubular shape, the rollers including a feature for forming a longitudinal guide channel in the tubular shape, with the stop dimple being along the guide channel; and a break off device in line with the rollformer that is adapted to break off sections of the tube at the score lines.

29. The apparatus defined in claim 28, including a welder positioned in line with the rollformer and that is adapted to create a weld bead that welds the tubular shape into a permanent tubular shape, the weld bead being spaced from the channel.

30. The apparatus defined in claim 28, wherein the scoring device includes scoring rollers with scoring members offset from a position where the scoring lines pass under the scoring rollers.

31. An apparatus comprising:

a scoring device for making transverse score lines on a roll of sheet material;

a dimpler adapted to form a stop dimple at a location coordinated with the score lines;

a rollformer with rollers configured and adapted to continuously form the sheet material into a tubular shape, the rollers including a feature for forming a longitudinal guide channel in the tubular shape, with the stop dimple being along the guide channel, the rollformer including rollers adapted to form in the sheet material a second channel at about 180 degrees from the first-mentioned channel; and a break off device in line with the rollformer that is adapted to break off sections of the tube at the score lines.

32. An apparatus comprising:

a scoring device having a scoring roller for making transverse score lines on a roll of sheet material;

a dimpler including a dimpler roller with punches offset longitudinally forwardly and rearwardly from a position where the scoring lines pass under the punches, the punches being configured to form dimples in the sheet material at locations spaced longitudinally from the score lines; and a rollformer adapted to continuously form the sheet material into a tubular shape, the rollformer including the scoring roller and the dimpler roller.

33. An apparatus comprising:

a scoring device having a scoring member for making transverse score lines on a roll of sheet material;

a dimpler including a dimpler roller with punches offset from a centerline of the sheet material for forming dimples in the sheet material;

a rollformer adapted to continuously form the sheet material into a tubular shape;

a welder positioned in line with the rollformer and that is adapted to weld the tubular shape into a permanent tube; and a break-off device in line with the rollformer that is adapted to break off sections of the tube at the score lines.

34. The apparatus defined in claim 33, wherein the dimpler is configured to form dimples adjacent the scoring lines.

35. The apparatus defined in claim 34, wherein the dimpler punch that forms a protruding dimple adjacent each one of the scoring lines.

* * * * *